US005376009A

United States Patent [19]

Olsson et al.

[11] Patent Number: 5,376,009

[45] Date of Patent: Dec. 27, 1994

[54] ELECTRICAL CONNECTOR FOR FLEXIBLE CIRCUIT SUBSTRATE

[75] Inventors: Billy E. Olsson, New Cumberland; Iosif Korsunksy, Harrisburg, both of Pa.

[73] Assignee: The Whitaker Corporation, Wilmington, Del.

[21] Appl. No.: 145,950

[22] Filed: Oct. 29, 1993

[51] Int. Cl.[5] ..... H01R 9/09

[52] U.S. Cl. ..... 439/67; 439/74; 439/77; 439/157; 361/785; 361/801

[58] Field of Search ..... 439/67, 74, 77, 157; 361/785, 803, 740, 801

[56] References Cited

U.S. PATENT DOCUMENTS

| | | | |
|---|---|---|---|
| 4,480,885 | 11/1984 | Coppelman | 339/45 M |
| 4,621,305 | 11/1986 | Daum | 439/77 X |
| 4,762,500 | 8/1988 | Dola et al. | 439/79 |
| 4,850,883 | 7/1989 | Kabadi | 439/67 |
| 5,156,553 | 10/1992 | Katsumata et al. | 439/62 |
| 5,199,885 | 4/1993 | Korsunsky et al. | 439/79 |

*Primary Examiner*—Kenneth J. Ramsey
*Attorney, Agent, or Firm*—Anton P. Ness

[57] ABSTRACT

A high density connector (12) for connecting to circuitry on a flexible circuit substrate (16). The connector (12) includes a stiffener member (14) that is attached to the connector housing (36) so that the flexible substrate (16) is clamped therebetween. Tails (46) of ground buses (40) within the connector extend through flexible substrate (16) and through openings (48) in the stiffener member (14) and are bent over into recesses (58) to hold the stiffener member (14) and connector (12) firmly against the substrate (16) along the entire length of the connector. Pivotal levers (90) are provided to cooperate with the stiffener member (14) to secure connector (12) to a mating connector (18) in mating engagement when pivoted to a closed position, and to separate the connectors (12,18) with minimum bowing of connector (12) when pivoted to an open position.

26 Claims, 6 Drawing Sheets

ELECTRICAL CONNECTOR FOR FLEXIBLE CIRCUIT SUBSTRATE

The present invention is related to electrical connectors for connecting to circuitry on flexible circuit substrates and means for separating such mated connectors.

BACKGROUND OF THE INVENTION

Electrical connectors designed for connecting to circuitry on flexible substrates typically have physically stronger structures than do other connectors to compensate for the lack of support normally provided by a rigid circuit board. When two mated connectors are separated, it is common practice to use a mechanism that engages the ends of the connectors and pries them apart. Since the forces holding the two connector halves together are greater in the center of the connector than at each end, there is a tendency for the ends to break loose first followed by the center. This, of course, causes the connector halves to bow during separation. This is especially the case when one of the connector halves is connected to circuitry on a flexible circuit substrate. Bowing of such connectors can damage the flexible circuit substrate or adversely affect the electrical contact between the connector contacts and the metalized circuitry on the flexible substrate. As connectors become more miniaturized and contact density increases, there tends to be less room for the connector housing, thereby making it difficult to provide the necessary rigidity to keep bowing within acceptable limits. What is needed is a connector for high density flexible circuit applications that has a mechanism for separating the connector halves while minimizing bowing of the connector to maintain the physical integrity of the flexible circuit and the electrical connection thereto.

SUMMARY OF THE INVENTION

The present invention is an electrical connector adapted to electrically interconnect to circuitry on a flexible circuit substrate. The connector includes an insulating housing and a plurality of electrical contacts in the housing having tails extending from the contacts which are adapted for electrical engagement with the circuitry. A stiffener member is provided that is attachable to the housing to prevent substantial bowing thereof. The stiffener member is attachable by means of some of the tails extended through holes in the stiffener member wherein the ends of the tails are deformed so that the flexible circuit substrate is clamped therebetween.

DESCRIPTION OF THE PREFERRED EMBODIMENT

Figure 1:
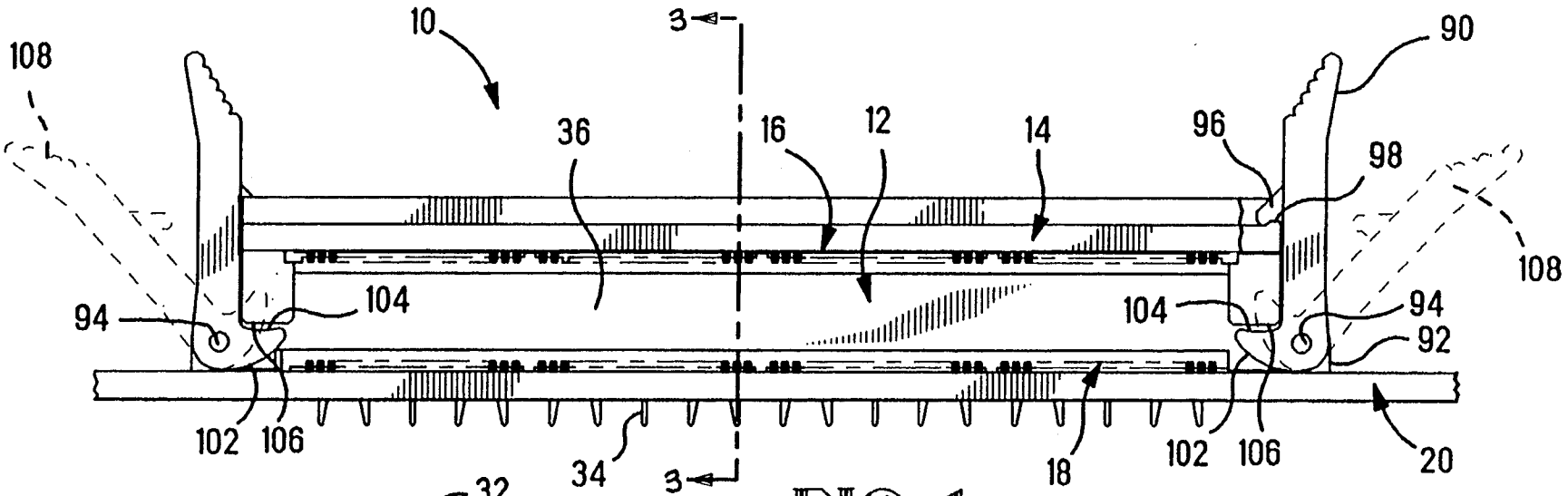
FIGS. 1 and 2 are front and side views of a connector incorporating the teachings of the present invention.
Figure 2:
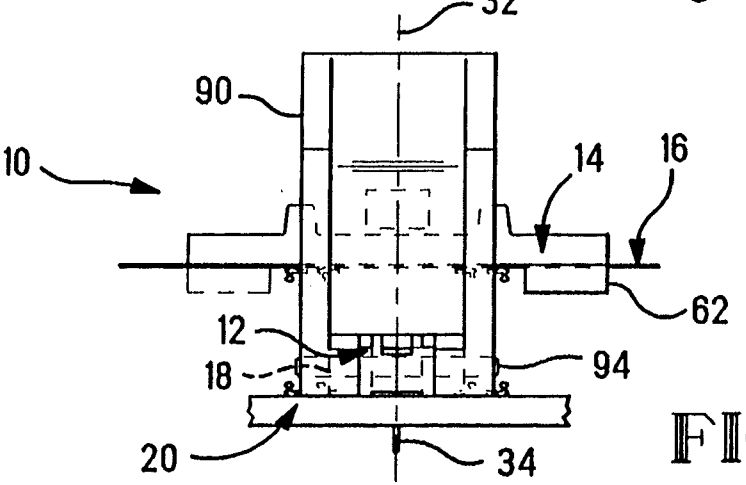
Figure 3:
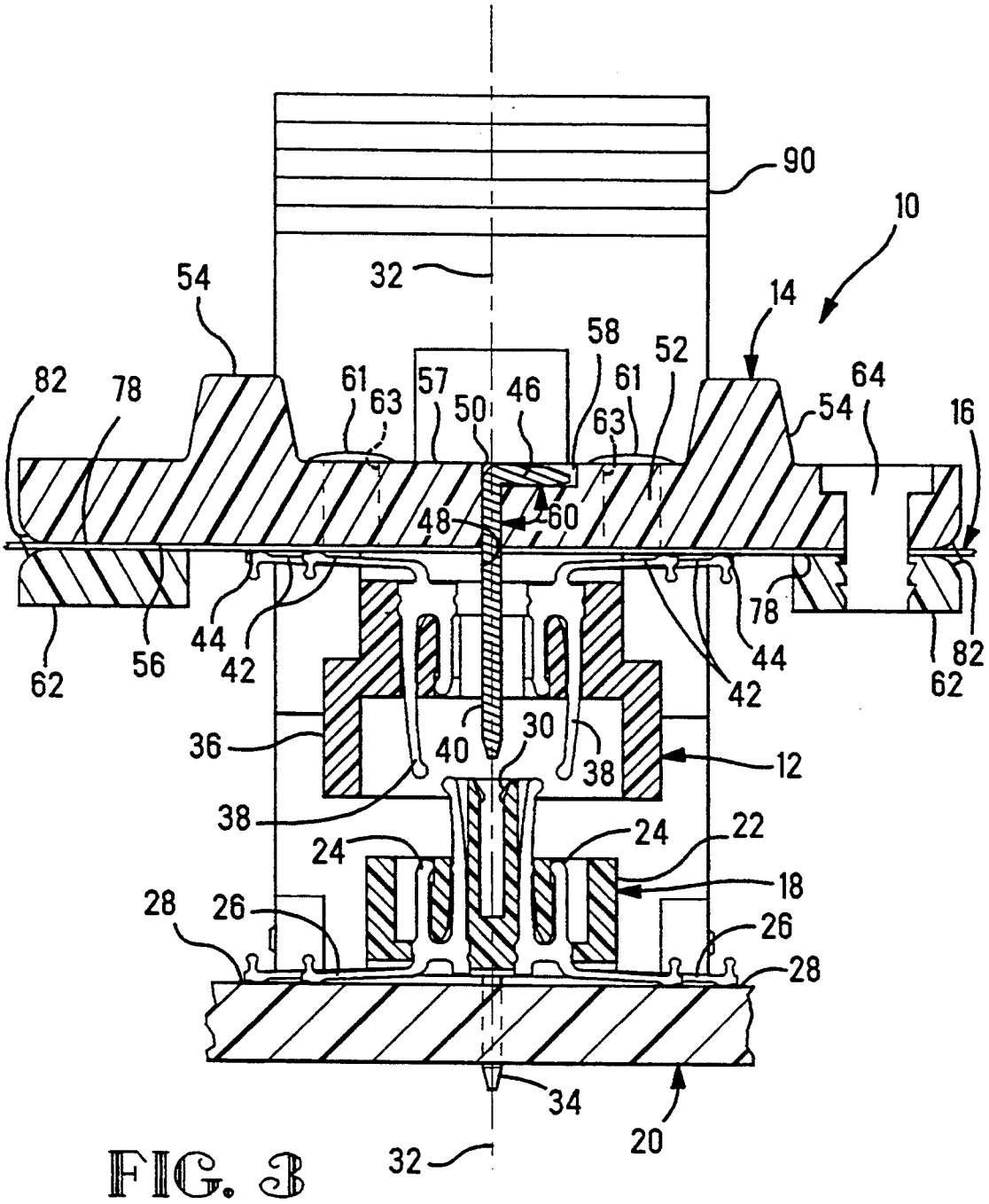
FIG. 3 is a cross-sectional view taken along the lines 3—3 in FIG. 1.

There is shown in FIGS. 1, 2, and 3 a connector assembly 10 consisting of a connector receptacle 12, a stiffener member 14, and a flexible circuit substrate 16 clamped therebetween. A connector plug 18, which mates with the receptacle 12, is attached to a major surface of a circuit board 20. This connector arrangement interconnects circuitry, not shown, on both the flexible circuit substrate 16 and the circuit board 20.

As best seen in FIG. 3 the plug 18 has an insulating housing 22 and a plurality of electrical contacts disposed therein, some of which are signal contacts 24 having tails 26 that are soldered to metalized pads 28 on the circuit board 20 and some of which are ground contacts 30 that form a ground bus that is arranged along a centerplane 32 of the connector and runs a major portion of the length of the plug 18. A similar connector is disclosed in U.S. Pat. No. 5,199,885. The ground contacts 30 have tails 34 that extend through openings in the circuit board 20. The receptacle 12 has an insulating housing 36 and a plurality of electrical contacts disposed therein, some of which are signal contacts 38 for mating with the contacts 24 and some of which are ground contacts 40 for mating with the contacts 30. The contacts 38 have tails 42 that are soldered to metalized pads 44 on the flexible circuit substrate 16, shown in FIG. 4. The ground contacts 40, on the other hand, have tails 46 that extend through openings 48 in the flexible circuit substrate 16 and through holes 50 in the stiffener member 14. The tails 46 are soldered to a common ground pad 49 (shown in phantom) of ground circuitry on the flexible circuit substrate adjacent the openings 48 preferably on the opposite surface from pads 44.

Figure 6:
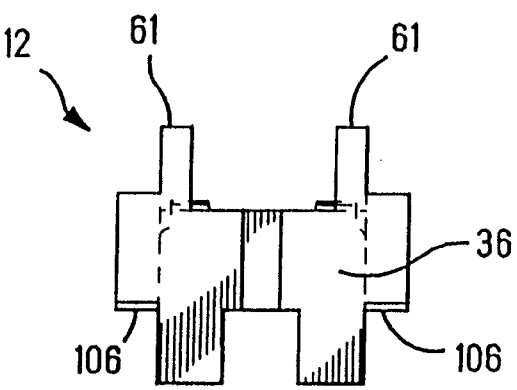
FIGS. 5 and 6 are front and end views of the connector receptacle shown in FIG. 1.
Figure 5:
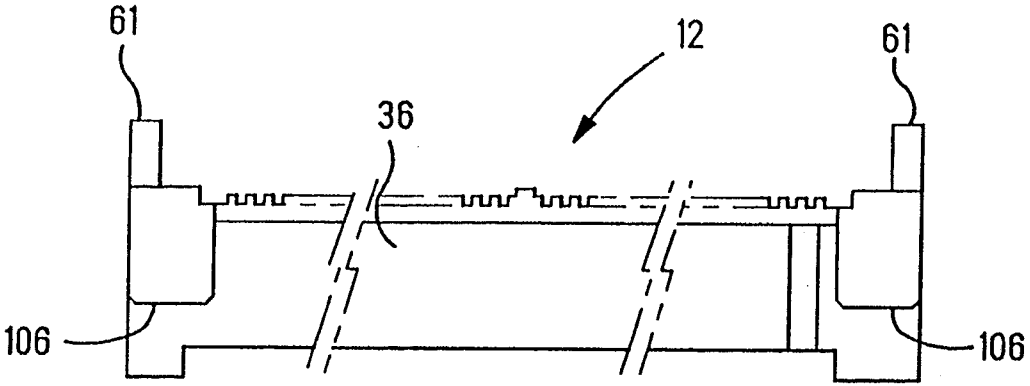
Figure 10:
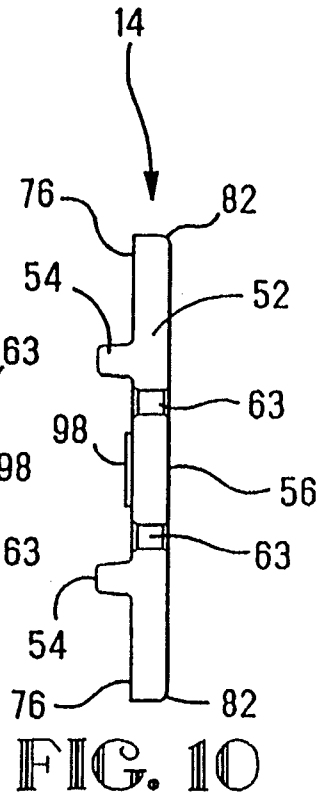
FIGS. 9 and 10 are plan and end views of the stiffener shown in FIG. 1.
Figure 9:
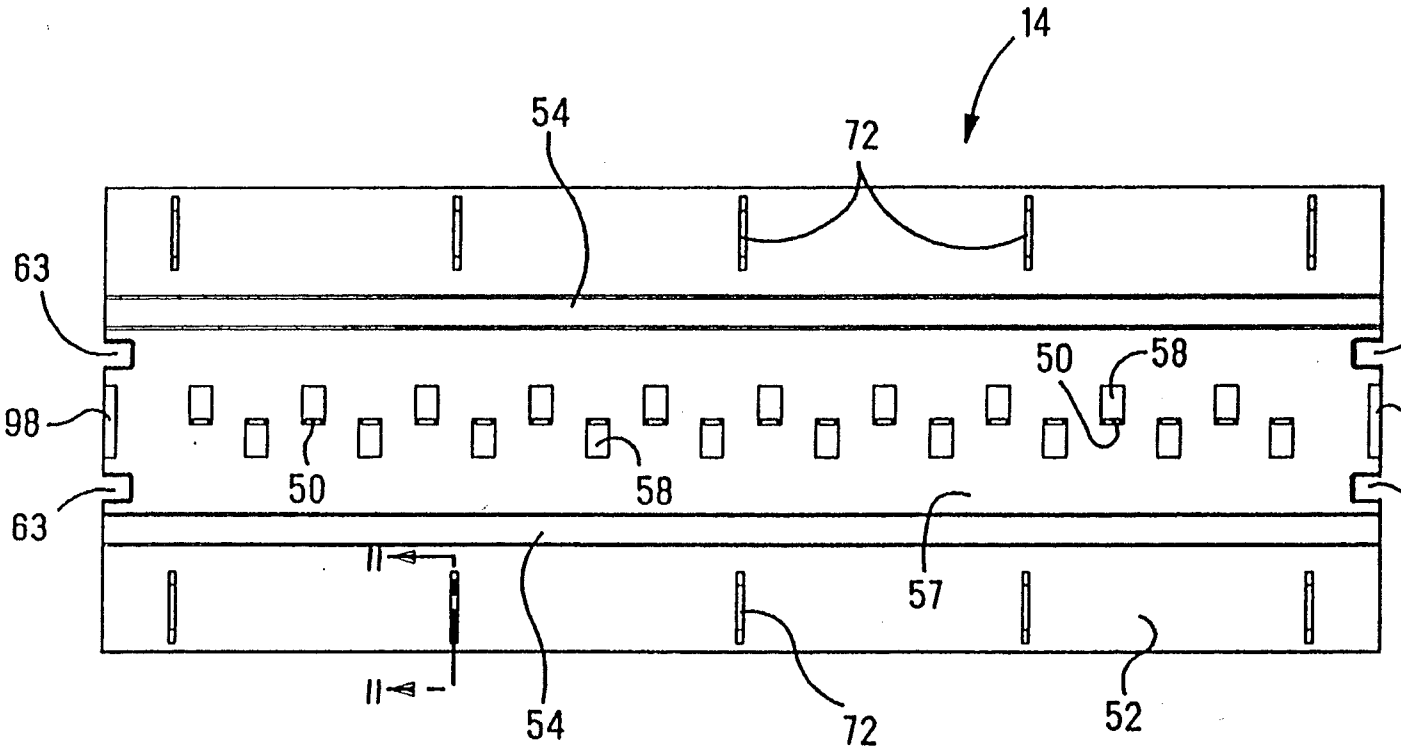

As best seen in FIGS. 3, 9, and 10, the stiffener member 14 is an elongated plate 52 having two spaced, parallel raised ribs 54 running the length of the member. The stiffener member has a major substantially flat surface 56, against which the flexible circuit substrate is clamped. The two raised ribs are equally spaced on either side of the centerplane 32 while the holes 50 are arranged in a line along the centerplane in alignment with the tails 46 of the ground contacts 40. Each hole 50 has a recess 58 formed in the surface 57 adjacent the hole. The depth of the recess is greater farther from the hole so that an angle 60 is formed between the floor of the recess and the hole 50 that is less than 90 degrees. The recesses 58 alternately extend in opposite directions away from the centerplane, as shown in FIG. 9. As is best seen in FIG. 3, the tails 46 are deformed by being bent over into the recesses 58 until they are against the floor thereby clamping the flexible circuit substrate 16 between the receptacle housing 36 and the major surface 56 of the stiffener member 14. Since the floors of the recesses 58 are slanted, the bend of the tails 46 exceeds 90 degrees thereby assuring maximum holding strength. Additionally, the extension of adjacent recesses in opposite directions requires that the tails 46 be bent, alternately, in opposite directions thereby adding to this holding strength. The stiffener member is made of a suitable material having sufficient strength to reduce bowing of the connector assembly 10, during mating and unmating, to within acceptable limits. Additionally, the stiffener member 14 is attached to the receptacle housing 36 by means of four projections 61 that extend upwardly from the housing, as best seen in FIGS. 5 and 6, and through corresponding openings 63 in the ends of the stiffener 14. The ends of the projections 61 are heat or ultrasonically staked to secure the ends of the receptacle housing 36 to the ends of the stiffener member 14, as shown in FIG. 3.

Figure 4:
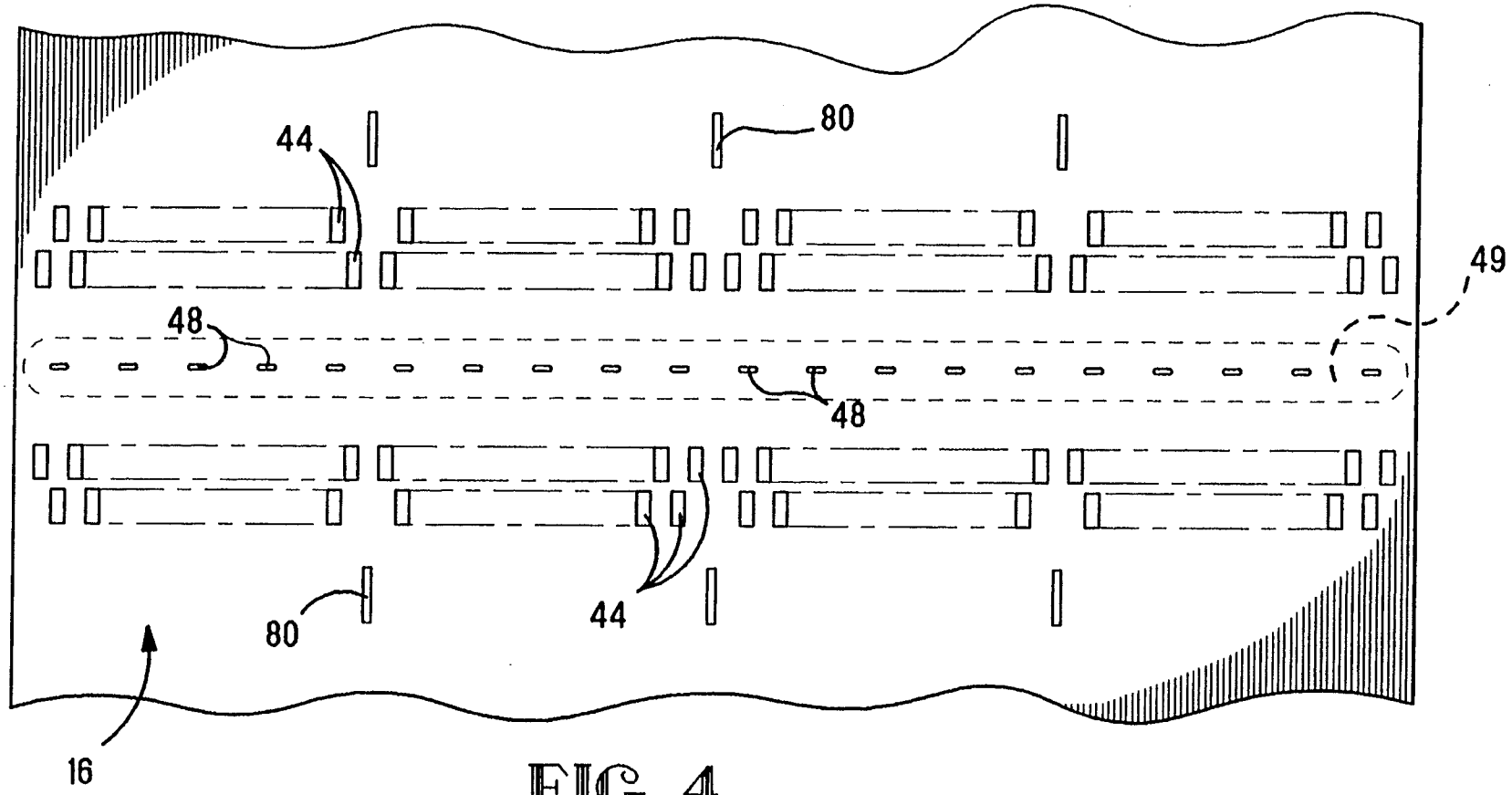
FIG. 4 is a plan view of a flexible circuit substrate.
Figure 8:
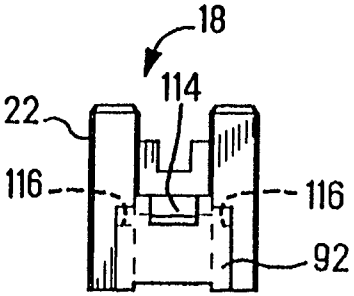
FIGS. 7 and 8 are front and end views of the connector plug shown in FIG. 1.
Figure 7:
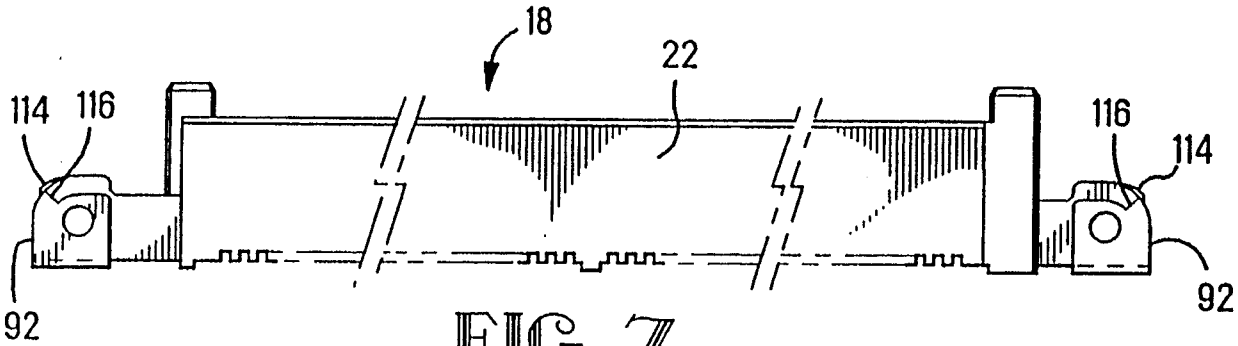
Figure 11:
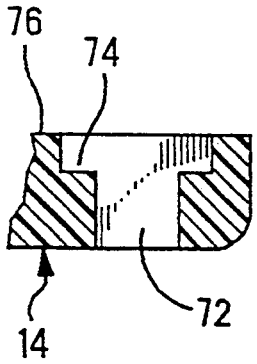
FIG. 11 is a partial cross-sectional view taken along the lines 11—11 in FIG. 9.
Figure 12:
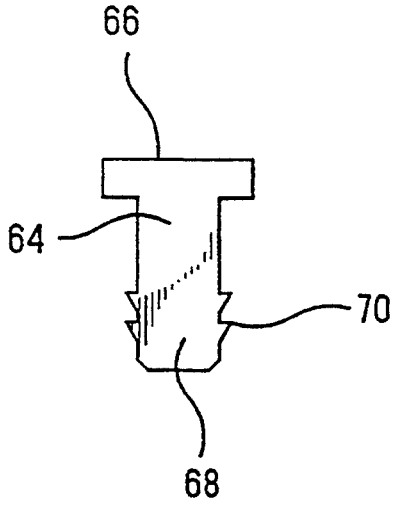
FIG. 12 is a front view of a retainer clip.
Figure 13:
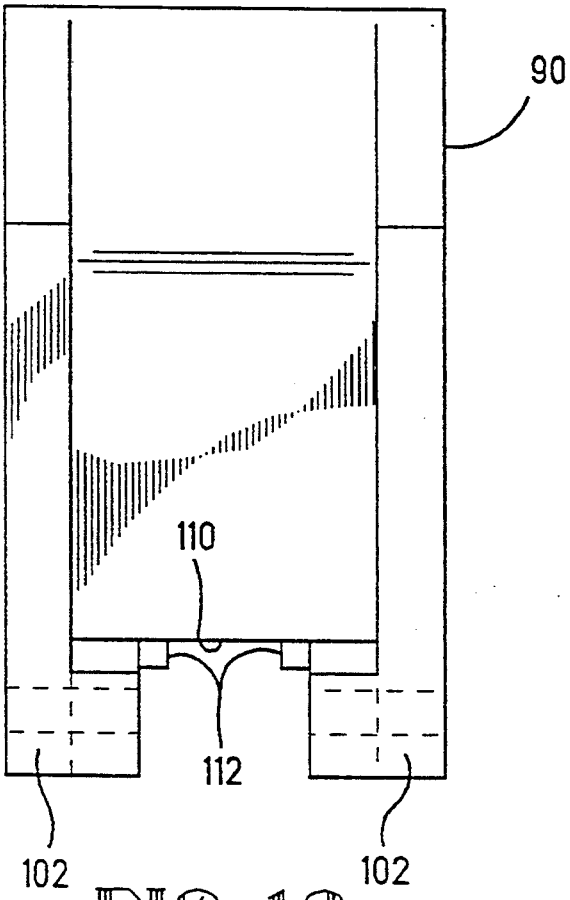
FIG. 13 is a front view of a pivotal lever shown in FIG. 1.
Figure 14:
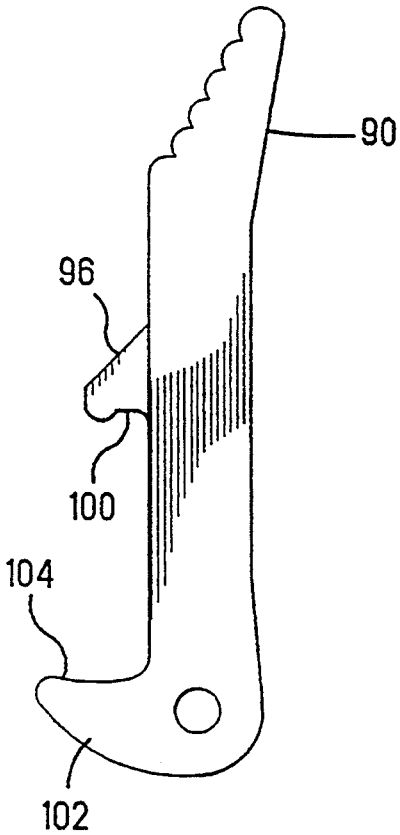
FIG. 14 is an end view of the lever shown in FIG. 13.

As shown in FIG. 3, a pair of strain relief member 62 are attached to the stiffener member 14 by means of several retainer clips 64, in the present example five such clips are used for each member 62. As shown in FIG. 12 each retainer clip 64 includes an enlarged head 66 and a shank 68 having barbs 70 formed thereon. The clips are made of a relatively thin sheet metal such as steel or brass. Ten equally spaced openings 72, five on each side, are formed in the stiffener member 14 near its edges, as shown in FIG. 9. These openings are formed as slots through the stiffener member and, as best seen in FIG. 11, each has an enlarged portion 74 in the surface 76 for receiving the head 66 of the retainer clip 64, thereby preventing the clip from passing completely through the slot. The strain relief members 62 have corresponding openings therein for receiving the shanks 68 and are sized so that the barbs 70 dig into the member 62 and secure it to the stiffener member. The flexible circuit substrate 16, as shown in FIG. 4, has clearance openings 80 formed therethrough in alignment with the openings 72 for passage of the shanks 68. When assembled, a portion 78 of the flexible circuit substrate adjacent the tails 42 is firmly clamped between each strain relief member 62 and the major surface 56 of the stiffener member 14. A generous radius 82 is formed on each of the adjacent corners of the strain relief men, her and the stiffener to reduce the damaging effects of bending of the flexible circuit substrate during handling. There is shown in FIG. 1 a pair of levers 90, each lever being pivotally attached to a respective extension 92 on the ends of the plug housing 22 by means of a pin 94. Details of the lever 90 are shown in FIGS. 13 and 14, while details of the plug housing 22 are shown in FIGS. 7 and 8. The lever 90 includes a projection 96 that engages a raised portion 98 on the end of the stiffener member 14. The projection 96 includes a small recess 100 that mates with the raised portion 98 so that as the levers are pivoted to their fully latched position as shown in solid lines in FIG. 1, that is the two levers are pivoted toward each other, the projections snap into place securing the connector assembly 10 to the plug 18 with the contacts 24,30 in mating engagement with the contacts 38,40 respectively. The pivoting end of the lever 90 includes a pair of spaced projections 102 that extend lateral of the lever, each having a prying surface 104 facing upwardly toward the projection 96. Each end of the receptacle housing 36 includes a pair of bearing surfaces 106, as seen in FIGS. 1, 5, and 6, that are in direct alignment with and oppose a respective pair of the prying surfaces 104. Note that with the levers in their latched position, as shown in solid lines, there is a small clearance space between the prying surfaces and the bearing surfaces. When it is desired to separate the connector assembly 10 from the connector plug 18, The two levers 90 are pivoted outwardly and away from each other to the position shown in phantom lines at 108 in FIG. 1. As the levers 90 are pivoted outwardly the prying surfaces 104 engage the bearing surfaces 106 forcing the entire connector assembly 10 to move upwardly away from the connector plug 18. The connector assembly 10 is prevented from bowing any appreciable amount due to the stiffener men,her 14 being firmly attached to the receptacle housing 36 by means of the bent over tails 46.

Each lever 90 includes a cam engaging surface 110 and a pair of stop surfaces 112 adjacent the pivotal end thereof, as best seen in FIGS. 13 and 14. Each extension 92 of the plug housing 22 includes an arcuate raised cam surface 114 and a pair of stop surfaces 116. The stop surfaces 116 oppose the stop surfaces 112 of the lever 90 so that as the levers are pivoted away from each other to their fully open position, shown in phantom lines in FIG. 1, these stop surfaces mutually abut and stop further pivotal movement in that direction. Additionally, during that pivotal movement, the cam engaging surface 110 interferingly engages the cam surface 114 thereby resisting the pivotal motion of the lever. Preferably the center for the radius of cam surface 114 is slightly offset outwardly from the center of pivot 94. As a result, as the pivoting movement of the lever continues, the resistance to the movement increases until the stop surfaces are engaged. At this point the two levers 90 are held in their full open position by this interference so that they cannot interfere with mating or unmating of the connector assembly 10 to the plug 18. This is especially useful when the connector is mounted inverted to that shown in FIG. 1.

While, in the present example, the receptacle 12 is attached to the stiffener member 14 and the plug 18 is attached to the circuit board 20, it will be understood that the receptacle may be attached to the circuit board and the plug attached to the stiffener member while advantageously practicing the teachings of the present invention. Additionally, the plug 18 is shown attached to a major surface of the circuit board 20, however, it may be attached to an edge of the circuit board in a manner described in U.S. Pat. No. 5,199,885. It will be appreciated by those skilled in the art that either the ground receptacle tails 34 or the ground plug tails 46 may be bent over in the recess 58 to secure its respective housing to the stiffener member 14.

An important advantage of the present invention is that the stiffener effectively prevents adverse bowing of the connector assembly attached to the flexible circuit substrate when separating the connector assembly from its mated connector half attached to the rigid circuit board, thereby protecting the delicate circuitry and connector contacts from damage. The use of the ground contact tails to clamp the flexible circuit substrate to the stiffener member is a simple and cost effective structure. Additionally, the increasing resistance to the pivotal motion of the levers, when moving them to their unlatched or open position, secures the levers in their open position to prevent interference by the levers when mating the connector assembly to the plug.

We claim:

1. An electrical connector adapted to electrically interconnect to circuitry on a flexible circuit substrate comprising:

(a) an insulating housing;

(b) a plurality of electrical contacts in said housing;

(c) tails extending from said contacts adapted for electrical engagement with said circuitry; and (d) a stiffener member attachable to said housing to prevent substantial bowing thereof, said stiffener member being attachable by means of some of said tails extended through holes in said stiffener member wherein the ends of said tails are deformed so that said flexible circuit substrate is clamped between said stiffener member and said housing.

2. The connector according to claim 1 wherein said stiffener member has first and second opposite ends having at least one opening for receiving a projection extending from said housing, said projection arranged to be heat staked to its respective said first or second end.

3. The connector according to claim 2 wherein said stiffener includes a substantially flat major surface to which said flexible circuit is to be clamped and a pair of spaced, parallel ribs on a surface opposite said major surface, said holes for receiving said tails being disposed between said two ribs.

4. The connector according to claim 3 wherein said holes are spaced along a centerplane of said connector when said stiffener is assembled to said connector, each said hole having a recess adjacent thereto in said surface opposite said major surface for receiving said deformable end of said tail.

5. The connector according to claim 4 wherein said recesses extend from their respective holes outwardly away from said centerplane, wherein adjacent recesses extend in opposite directions.

6. The connector according to claim 5 wherein each recess has a depth adjacent its respective hole that is less than its depth spaced away therefrom.

7. The connector according to claim 3 including a strain relief member attachable to said stiffener to clamp a portion of said flexible circuit substrate, adjacent said tails, against said major surface.

8. The connector according to claim 7 including a plurality of retainer clips, each of which has a head and a barbed shank, and wherein said stiffener has a plurality of openings for receiving said heads, said shanks adapted to extend through said openings and into aligned openings in said strain relief member for clamping said portion of said flexible circuit substrate between said major surface of said stiffener and said strain relief member.

9. The connector according to claim 7 wherein opposing corners of said stiffener and said strain relief member are radiused along their entire lengths.

10. An electrical connector in combination with a flexible circuit substrate, said connector having an insulating housing and a plurality of contacts therein, each of said contacts having tails in electrical engagement with circuitry on said flexible circuit substrate, said connector including a stiffener member attached to said connector housing to inhibit bowing thereof, said attachment effected by means of some of said tails extending through holes in said stiffener and deformed to hold said tails in place so that said flexible circuit substrate is clamped therebetween.

11. The connector according to claim 10 wherein said stiffener member has first and second opposite ends having at least one opening for receiving a projection extending from said housing, said projection arranged to be heat staked to its respective said first or second end.

12. The connector according to claim 11 wherein said stiffener includes a substantially flat major surface to which said flexible circuit is clamped, and a pair of spaced, parallel ribs on a surface opposite said major surface, said holes for receiving said tails being disposed between said two ribs.

13. The connector according to claim 12 wherein said holes are spaced along a centerplane of said connector, each said hole having a recess adjacent thereto in said surface opposite said major surface for receiving said deformed end of said tail.

14. The connector according to claim 13 wherein said recesses extend from their respective holes outwardly away from said centerplane, wherein adjacent recesses extend in opposite directions.

15. The connector according to claim 14 wherein each recess has a depth adjacent its respective hole that is less than its depth away therefrom.

16. The connector according to claim 15 wherein said deformed ends of said tails are deformed by bending each said end over the edge of its respective said hole and into its adjacent recess so that said end is bent more than 90 degrees.

17. The connector according to claim 12 including a strain relief member attached to said stiffener thereby clamping a portion of said flexible circuit substrate, adjacent said tails, against said major surface.

18. The connector according to claim 17 including a plurality of retainer clips, each of which has a head and a barbed shank, and wherein said stiffener has a plurality of openings for receiving said heads, said shanks extending through said openings and into aligned openings in said strain relief member thereby clamping said portion of said flexible circuit substrate between said major surface of said stiffener and said strain relief member.

19. The connector according to claim 17 wherein opposing corners of said stiffener and said strain relief member are radiused along their entire lengths.

20. An electrical connector in combination with a flexible circuit substrate, said connector comprising:

(a) a receptacle having an insulating housing;

(b) a plurality of contacts in said receptacle housing having tails extending therefrom;

(c) a plug having an insulating housing adapted to matingly engage said receptacle;

(d) a plurality of contacts in said plug housing adapted to electrically mate with said contacts in said receptacle housing, said contacts having tails extending therefrom;

(e) a stiffener member attached to one of either said receptacle housing or said plug housing so that said flexible circuit substrate is clamped therebetween and said tails of said contacts in said housing are in electrical engagement with circuitry on said flexible circuit substrate; and (f) lever means associated with the other of said receptacle housing or said plug housing for securing said plug and receptacle housings in said mating engagement when said lever means is pivoted in one direction and, in cooperation with said stiffener member, for moving said housings out of said mating engagement without imparting substantial bowing to said one housing when pivoted in an opposite direction.

21. The connector according to claim 20 wherein said lever means includes:

(a) a pair of levers, one such lever pivotally attached to each end of said other housing, each lever having a projection that engages each end of said stiffener when pivoted toward each other thereby securing said housings in said mated engagement; and (b) a cam surface on each end of said other housing and a corresponding cam engaging surface on each said lever arranged so that as said levers are pivoted away from each other said cam engaging surface interferes with said cam surface thereby resisting said pivotal movement of said levers.

22. The connector according to claim 21 wherein each said cam surface is an arcuate surface formed about a respective pivot of said levers whereby said arcuate surface is arranged so that said interference between said cam engaging surface of each lever and its respective said cam surface increases as said levers are pivoted further away from each other and decreases as said levers are pivoted toward each other.

23. The connector according to claim 22 wherein each end of said other housing has an abutting surface adjacent said cam surface and each lever has a stop surface that moves toward its respective said abutting surface when said levers are moved away from each other until said two surfaces engage thereby stopping further movement of said levers away from each other.

24. The connector according to claim 23 wherein each end of said stiffener member includes a raised portion and said projection of each lever includes a recess for receiving said raised portion so that when said levers are pivoted toward each other to secure said receptacle housing and said plug housing together said levers snap into locked engagement with said stiffener as each said raised portion engages its respective said recess.

25. The connector according to claim 23 wherein each end of said one housing has a bearing surface facing away from said major surface of said stiffener member and each said lever has a prying surface opposed to a respective bearing surface and arranged so that when said levers are fully toward each other and said plug and receptacle housings are secured together in said mating engagement said prying surfaces are spaced from their respective bearing surfaces, and as said levers are pivoted away from each other said prying surfaces engage their respective bearing surfaces and force said receptacle and plug housings to separate out of said mating engagement.

26. The connector according to claim 25 wherein said stiffener member is attached to said receptacle housing and said levers are pivotally attached to said plug housing.

* * * * *